US008789225B2

(12) United States Patent
Anderson et al.

(10) Patent No.: US 8,789,225 B2
(45) Date of Patent: Jul. 29, 2014

(54) INTERLOCKING HANDLE

(75) Inventors: Chad E. Anderson, Ypsilanti, MI (US); Jay L. Sackett, Ann Arbor, MI (US); Masaaki Tanaka, Novi, MI (US); Christian A. Trager, Canton, MI (US); Christopher M. Higgins, Ypsilanti, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 241 days.

(21) Appl. No.: 13/014,637

(22) Filed: Jan. 26, 2011

(65) Prior Publication Data

US 2012/0186045 A1 Jul. 26, 2012

(51) Int. Cl.
*B25F 1/00* (2006.01)
*B25B 23/16* (2006.01)

(52) U.S. Cl.
USPC ..... 7/100; 81/177.6

(58) Field of Classification Search
USPC ..... 7/100; 81/177.85
See application file for complete search history.

(56) References Cited

U.S. PATENT DOCUMENTS

| | | | | |
|---|---|---|---|---|
| 2,313,398 | A | 3/1943 | Ronning | |
| 3,555,583 | A | 1/1971 | Mousel | |
| 4,751,840 | A | 6/1988 | Windsor, Jr. | |
| 5,086,674 | A | 2/1992 | Her | |
| 5,197,164 | A * | 3/1993 | Meier | 24/16 PB |
| 5,272,942 | A | 12/1993 | Hull et al. | |
| 5,878,627 | A * | 3/1999 | McMurtrey | 74/544 |
| 6,237,894 | B1 | 5/2001 | Cotner et al. | |
| 7,228,766 | B1 | 6/2007 | Shyu | |
| 2006/0016298 | A1 | 1/2006 | Chang | |
| 2009/0038081 | A1 * | 2/2009 | Berton et al. | 7/100 |

FOREIGN PATENT DOCUMENTS

| | | |
|---|---|---|
| CN | 200947778 | 9/2007 |
| DE | 4210593 | 10/1993 |
| JP | 7309596 | 11/1995 |
| JP | 9202600 | 8/1997 |
| JP | 2000247585 | 9/2000 |

* cited by examiner

*Primary Examiner* — Monica Carter
*Assistant Examiner* — Danny Hong
(74) *Attorney, Agent, or Firm* — Snell & Wilmer LLP

(57) ABSTRACT

Apparatus, devices, methods and systems corresponding to one or more embodiments relating to a jack handle for operation of a vehicle jack is described herein. In one embodiment, a two-piece jack is described. A first piece may include a handle and a first interlock portion. A second piece may include a jack mating portion, a second interlock portion for engagement with the first interlock portion of the first piece and a stopper for preventing the first piece and second piece from becoming disengaged during operation.

20 Claims, 5 Drawing Sheets

INTERLOCKING HANDLE

BACKGROUND

1. Field

The present disclosure relates to apparatuses, systems and/or methods relating to a device for operating a product, such as a car jack. For example, an apparatus within the scope of the invention may be a jack handle attachable to a car jack for raising or lowering the car jack. However, the concepts herein may be applicable to other handle apparatuses as well.

2. Description of the Related Art

Most vehicles produced nowadays include a jack to allow a driver or passenger to deal with situations such as a flat tire. Traditionally, the jack raises a portion of the vehicle off the ground to allow the driver or passenger to change the tire or to maneuver below the vehicle to look and/or perform other functions that may be difficult with the vehicle situated flat on the ground. However, operation of a car jack, such as a scissor jack among other types of jacks, might require additional components like a jack handle. In some situations, the jack handle and the car jack are not combined into one apparatus. By separating the jack handle and the car jack, certain advantages may be obtained. For example, storage of the jack handle and the car jack may be easier when separated. As such, different jack handles have been developed for operation with the car jack.

As is known in the art, jack handles may include a first arm to attach to the car jack, and a second arm attached to the first arm to form a L-shape, thereby providing an increase in the mechanical advantage provided to the user, and thus allowing the user to easily raise and/or lower the car jack (e.g., a scissor jack). However, current methods practiced to attach the first arm and the second arm are lacking.

One example of a currently known jack handle is a two-piece jack handle without an interlock. However, without care by the operator, the first arm and the second arm of the handle may become separated during use. Indeed, the driver or passenger may become frustrated if he or she has to continually re-attach the first arm and the second arm of the jack during a tire change operation. Accordingly, an interlock that reduces the likelihood of separation of the first arm and the second arm is desirable.

A second type of jack handle known in the art is one that incorporates a ball-snap or thumb-screw to attach a first arm to a second arm. However, the driver or passenger using this type of jack handle may be inconvenienced in a different fashion—namely that it is too difficult and time consuming to assemble and/or disassemble the jack handle. In addition, the manufacturing costs for jack handles of these types are increased because of the intricate nature of the ball-snap and/or the thumb-screw. For at least these reasons, even these more advanced types of jack handles are not optimal.

One piece jack handles that integrate the pivot arm and the rotation arm suffer from difficulty of storage especially since these jack handles may be large in size.

What is needed is a jack handle that may provide the passenger and/or driver with one or more advantages such as reliable attachment of the components of the jack handle without unduly increasing the difficulty in assembly, reduced manufacturing costs and easy storage.

SUMMARY

One or more embodiments corresponding to apparatuses, devices, systems and/or methods relating to a jack handle for operation of a vehicle jack is described herein. However, the concepts herein are not limited to usage with a jack handle or a vehicle jack, but instead are described in relationship with a jack handle (for a vehicle jack) merely for clarity and to serve as an example. In one embodiment, a novel two-piece jack is described. The first piece may include a handle and a first interlock portion. The second piece may include a jack mating portion, a second interlock portion for engagement with the first interlock portion of the first piece and a stopper for preventing the first piece and second piece from becoming disengaged during operation. In one embodiment, the stopper may be part of the first piece (which may include the handle and the first interlock portion).

In one embodiment, the first piece and/or the second piece may be integrated with an additional tool that may be advantageous in other vehicle-related operations. In one example, one end of the first or second piece may include an integrated lug wrench. The integrated lug wrench may allow an operator to unscrew the lugs holding the wheel in place to continue the wheel-changing process. In a further embodiment, a spoon or wedge shape may be integrated in the first piece and/or the second piece while remaining separate from a stopper.

In one embodiment, the stopper may be shaped and/or integrated with an additional tool that may be advantageous during traditional uses of the jack. In one example, the stopper may be shaped like a spoon, wedge or other shape to allow a driver or passenger to pry or remove a vehicle's wheel cover during the changing of the wheel of the vehicle.

In one embodiment, the interlock of the first piece when engaged with the interlock of the second piece, may allow force transmission between the first piece and the second piece. In one example, the interlock of the first piece may be a male component and the interlock of the second piece may be a female component configured to receive the male component. The male component may include a force transferring surface configured to contact a corresponding force transferring surface of the female component. In this fashion, force may be transmitted between the first piece and the second piece. The shape of the force transferring surface may be varied. In one example, the shape of the force transferring surface of the male component may be an oblong portion of the first piece, and the shape of the force transferring surface of the female component may be the edges of a cross-shaped cut-out.

This Summary is included as to introduce, in an abbreviated form, various topics to be elaborated upon below in the Detailed Description. This Summary is not intended to identify key or essential aspects of the claimed invention. This Summary is similarly not intended for use as an aid in determining the scope of the claims.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Apparatus, systems and/or methods that implement the embodiments of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between referenced elements.

Figure 1:
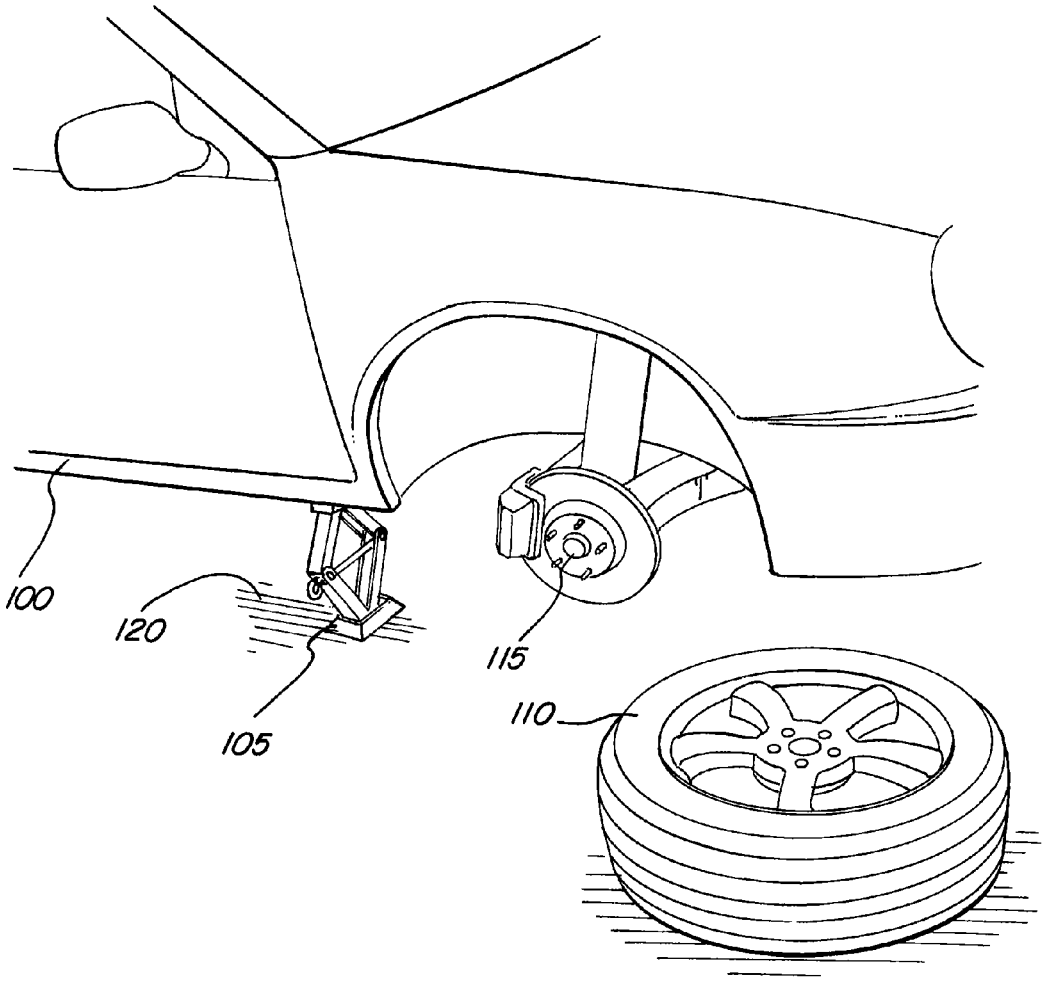
FIG. 1 illustrates a functioning vehicle jack according to one or more embodiments described herein.

FIG. 1 illustrates the general functionality of a jack 105 (e.g., a vehicle jack). As shown and described herein, the jack 105 is a type of jack generally known as a scissor jack. However, the disclosure is not limited in applicability to scissor jacks. Indeed, the jack handle described herein may be modified to be compatible with any type of jack that may function to raise a vehicle off the ground or lower a raised vehicle back down to the ground. As shown in FIG. 1, vehicle 100 is raised off the ground 120 by the jack 105. The wheel 110 is shown removed from an axle 115 as is typically performed by an individual desiring to change the wheel 110 or to access the axle 115 or other parts of the vehicle 100 not otherwise accessible. The jack 105 is generally constructed out of steel or an alloy sturdy enough to withstand the weight of the vehicle 100 which may be on the order of tons.

Figure 2:
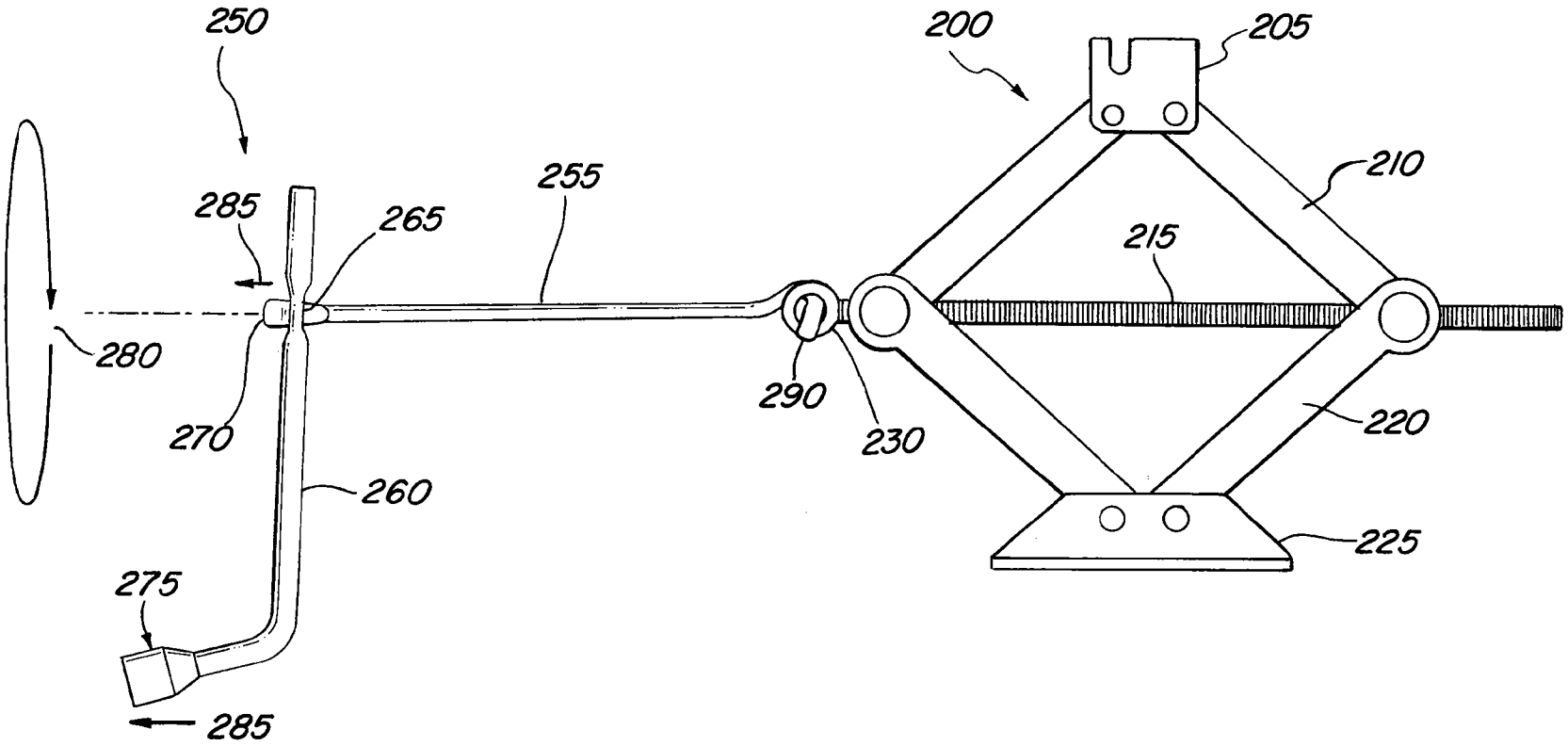
FIG. 2 illustrates a vehicle jack-jack handle assembly according to one or more embodiments described herein.

FIG. 2 illustrates a diagram of how the jack 200 may be operated. As discussed above, the main function of a jack (e.g., jack 200) is to raise and/or lower a vehicle according to the desires of the person operating the jack. For example, in preparing to replace a tire, the driver may use a jack (e.g., jack 200) to raise the vehicle off the ground, thereby making it possible for the driver to remove the tire, and attach a replacement tire. Upon completion, the driver may use the jack to lower the vehicle (i.e., the tire) back onto the ground. To perform these functions, a jack handle 250 may be required. That is, the jack handle 250 may be used in conjunction with the jack 200 to raise or lower the jack 200 (which in turn raises and lowers the vehicle).

As shown in FIG. 2, the jack handle 250 may include a pivot arm 255 and a rotation handle 260. Generally, the driver or any operator of the jack 200 may turn the rotation handle 260 in a circular fashion (e.g., like a crank) in a first direction 280 (e.g., clockwise direction) to raise the jack 200 and may turn the rotation handle 260 in a reverse direction (e.g., counter clockwise direction) to lower the jack 200. As shown, the rotation handle 260 may be attached to the pivot arm 255 at location 265. In one embodiment, a stopper 270 is included to prevent the rotation handle 260 from being dislodged from the pivot arm 255 during operation. Furthermore, the curved handle of the rotation handle 260 may allow for easier operation of the jack handle 250. The pivot arm 255 may include a hook or a jack mating portion 290 which "hooks" or otherwise engages the insertion portion 230 of the jack 200. In this fashion, when the rotation handle 260 is turned, the force is transferred to the screw 215 of the jack 200 and the upper arms 210 and the lower arms 220 are either incrementally brought together or spread apart. When the upper arms 210 and the lower arms 220 are brought together, the top bracket 205 is lowered closer to the foot 225 of the jack 200, thereby lowering a vehicle (e.g., vehicle 100) pressed against the top bracket 205. Accordingly, when the upper arms 210 and the lower arms 220 are spread apart, the top bracket 205 is raised away from the foot 225 of the jack 200 causing the vehicle (e.g., vehicle 100) pressed against the top bracket 205 to be raised.

Figure 3:
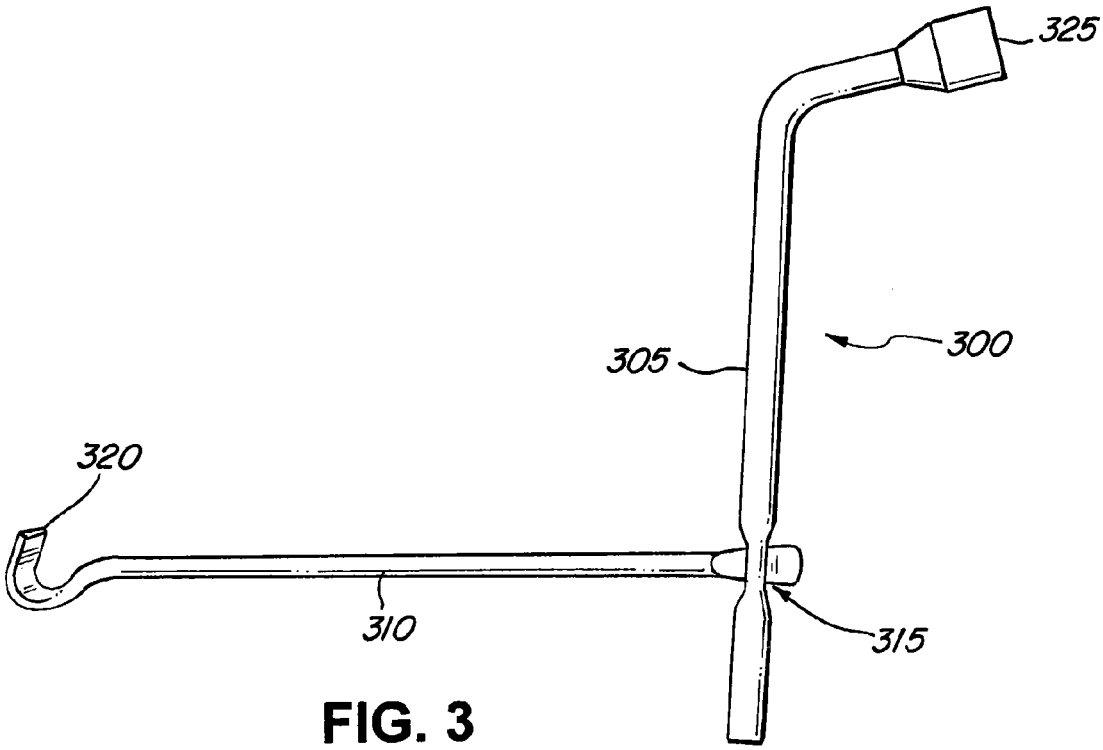
FIG. 3 illustrates a jack handle assembly according to one or more embodiments described herein.

FIG. 3 illustrates the jack handle in an assembled state according to one or more embodiments described herein. The jack handle 300 may comprise two separate components, a handle component 305 and a jack mating component 310. These two separate components may be detachably lockable in an interlocked state at an interlock position 315 when the jack mating component 310 is inserted into the handle component 305 and pulled or slid through such that the jack mating component 310 cannot be pulled anymore and is thus "locked" at the interlock position 315. The handle component 305 may include a crank handle 325 graspable by a user for manipulation of the jack handle 300. The jack mating component 310 may include a jack mating portion 320, which in one embodiment, may be a hook-like device. As illustrated, when the jack handle 300 is in the interlocked state, the two components or pieces (e.g., the handle component 305 and the jack mating component 310) may appear to be substantially perpendicular or orthogonal to one another (e.g., in a L-shape). Furthermore, at least one end of each component may include a curve. For example, the handle component 305 may include a curved crank handle 325, and the jack mating portion 320 may include a curved jack mating portion 320. When assembled and in the interlock state, the jack handle 300 may operate similarly to the jack handle 250 as shown in FIG. 2.

Figure 4:
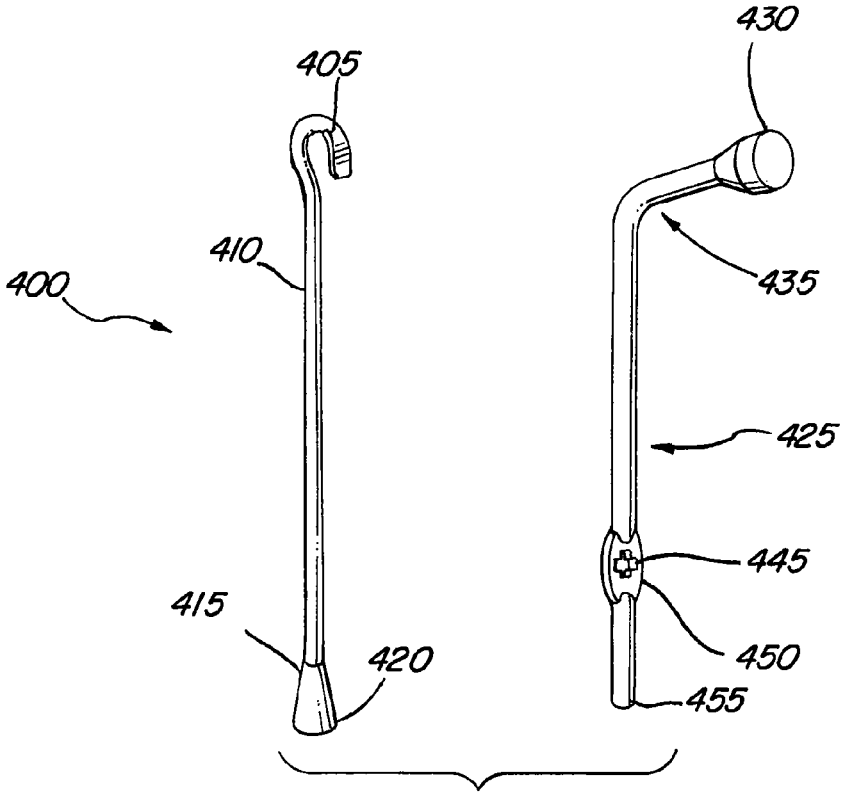
FIG. 4 illustrates a disassembled jack handle according to one or more embodiments described herein.

FIG. 4 illustrates the two jack handle components (e.g., the handle component 305 and the jack mating component 310) in a non-assembled state. Accordingly, by allowing the two components to separate and assemble as needed by the driver or the passenger, benefits such as improved ease of storage may be achieved. Regardless, as shown, the jack mating component 400 may include a jack mating portion 405, a body portion 410, an interlock piece 415 and a stopper 420. The jack mating portion 405, similar to the jack mating portion 320 of FIG. 3, may be configured to attach an assembled jack handle (e.g., jack handle 250 or 300) to a jack (e.g., jack 200). While shown as a hook like device herein, any number of jack attachment devices may be implemented in place of the hook. The body portion 410 may be configured to be cylindrical in nature to allow for ease of handling. In addition, the body portion 410 may be configured to have a diameter or thickness smaller than an opening of the cut-out portion 445 of the handle component 425. In other words, the girth of the body portion 410 may be configured to be small enough so that the jack mating portion 405 may be inserted through the cut-out portion 445 and pulled or slid through until held in place by the stopper 420. The interlock piece 415 may be configured to be the point of contact (and thus, also the point where force is transferred) between the jack mating component 400 and the handle portion 425. As shown, the interlock piece 415 may be a "male" component and may be configured to be inserted into its "female" component counterpart, namely, the cut-out portion 445. While shown here to be an oblong portion of substantially even girth, the interlock piece 415 may have a thicker circumference as compared to the body portion 410. Whereas one function of the body portion 410 is to allow the jack mating portion 405 to be inserted into and slid through the cut-out portion 445, the interlock piece 415 functions to contact the cut-out portion 445 and may act as a force transferring conduit. The stopper 420 may, in one embodiment, have an even larger girth as compared to the interlock piece 415. By having a larger circumference, the stopper 420 may be larger than the cut-out portion 445 thereby preventing the jack mating component 400 from exiting the cut-out portion 445 during an assembly process (e.g., when the jack mating component 400 is inserted into the handle portion 425). In one embodiment, the stopper 420 incrementally increases in girth before tapering off to a rounded edge. The rounded edge may be advantageous for ease of handling. While different portions of the jack mating component 400 have been described in this embodiment to have different structure and different functionality, the jack mating component 400 may be constructed out of one material, and if desired, as one piece. However, dividing the jack mating component 400 into several, attachable parts and using more than one material, such as utilizing a metal alloy for the body portion 410 and a rubber compound for the stopper 420 is still within the scope of the invention. In one embodiment, the body portion 410 and the stopper 420 may both be made of a plastic material or any other suitable material. All materials discussed herein are examples and may be mixed and matched.

The other component besides the jack mating component 400 shown in FIG. 4 is the handle component 425. The handle component 425 may include a crank handle 430, a curved portion 435 (e.g., a neck portion), a body portion 440, a flat portion 450 (or flattened portion 450) including the cut-out portion 445 and an end portion 455. The crank handle 430 may be configured to be larger in girth when compared to the rest of the handle component 425. A larger crank handle 430 may allow for easier gripping by the driver or passenger manipulating the handle component 425. The crank handle 430 may be attached to a curved neck portion 435 of the handle component 425. The curvature of the curved portion 435 may improve the ease of use of the crank handle 430. The curved portion 435 may be attached, on the other side, to the body portion 440 of the handle component 425. The body portion 440 may increase the mechanical advantage of the handle component 425 when operated (e.g., being rotated about the axis defined by the length of the jack mating component 400). The body portion 440 may be attached to a flat portion 450 of the handle component 425. The flat portion 450 may be stamped, pressed or otherwise compressed. By compressing the flat portion 450, the ease of sliding the jack mating component 400 is enhanced. In other words, the flat portion 450 may function as a plane of insertion, and when the jack mating component 400 is inserted inside and across the plane of insertion and through the cut-out portion 445, the jack mating component 400 is guided by the edges of the cut-out portion 445 allowing the operator (e.g., driver or passenger) to continue to slide the jack mating component 400 through the plane of insertion without worrying about mis-configuration and/or misalignment until the stopper 420 prevents further sliding. As will be discussed in greater detail below, the edges forming and/or defining the cut-out portion 445 may include the force transferring surfaces and/or portions of the handle component 425. The flat portion 450 may be attached to an end portion 455. The end portion 455 may function to allow gripping of the handle component 425 at a tail end. As shown, the end portion 455 may be cylindrical in nature thereby allowing for easy of handling.

As designed, when the stopper 420 prevents further sliding and/or insertion of the jack mating component 400 through the cut-out portion 445 of the handle component 425, the force transferring surfaces and/or portions of the handle component 425 may be in physical contact with the force transferring surface of the interlock piece 415. In this state, the jack mating component 400 and the handle component 425 may be considered to be in an assembled or locked state (e.g., as shown in FIG. 3). The operator may disassemble and/or separate the jack mating component 400 and the handle component 425 via a reverse operation. That is, the jack mating portion 405 may be slid and brought closer, and then ultimately back through the cut-out portion 445, exiting the cut-out portion 445, and crossing again the plane of insertion (but from the reverse side). In this fashion, the stopper 420 is pulled away from the cut-out portion 445 and the force transferring surfaces are no longer in contact. While different portions of the handle component 425 have been described in this embodiment to have different structure and different functionality, the handle component 425 may be constructed out of one material, and if desired, as one piece. However, dividing the handle component 425 into several, attachable parts and using more than one material, such as utilizing a metal alloy for the body portion 440 and a rubber compound for the crank handle 430 is still within the scope of the invention. In one embodiment, the body portion 440 and the crank handle 430 may both be made of plastic or any other suitable material. All materials discussed herein are examples and may be mixed and matched.

Figure 5A:
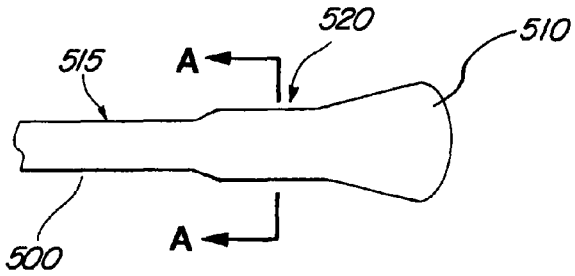
FIG. 5A illustrates a close up view of a male force transferring surface and a stopper of one piece of the jack handle according to one or more embodiments described herein.

While embodiments of the jack handle (e.g., jack handle 250 and 300) have been generally described, FIG. 5A illustrates an embodiment of the end portion 500 magnified here for illustrative purposes. As shown, the end portion 500 may include the interlock piece 415 of FIG. 4. As discussed above, and shown more clearly here, the body portion 515 may have a substantially smaller diameter when compared to the interlock portion 520, which in turn may have a substantially smaller diameter than the largest diameter of the stopper portion 510. In addition to employing varying diameters, each portion (e.g., the body portion 515, the interlock portion 520 and the stopper portion 510) may have a different shape. For example, a cross-section view (not shown) of the body portion 515 may reveal that the body portion 515 is substantially circular or round. In contrast, the stopper portion 510 may be beaker-shaped. That is, the diameter of a cross-section of the stopper portion 510 may increase moving away from the body portion 515 before decreasing in diameter and closed off with a rounded surface. However, in one embodiment, the end of the stopper portion 510 may be flat.

Figure 5B:
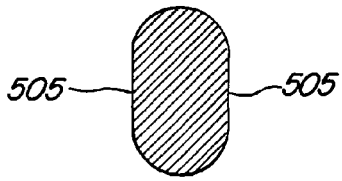
FIG. 5B illustrates a cross-sectional view of the male force transferring surface of FIG. 5A according to one or more embodiments described herein.

FIG. 5B is a cross section view along axis A-A depicted in FIG. 5A. Here, the cross sectional view illustrates the force transferring surfaces 505 of the interlock portion 520. As shown, the general shape of a cross section of the interlock portion 520 may be a distorted oval. However, other shapes are possible (e.g., a smooth oval, a square, etc.). The force transferring surfaces 505 of end portion 500 may be in physical contact with the force transferring surfaces 505 of the handle component (e.g., handle 425). In one embodiment, the force transferring surfaces 505 may be coated with a layer of erosion-resistant paint or sealant (e.g., acrylic rubber or silicon rubber) for protecting the force transferring surfaces 505 from being worn down from repeated friction created when the force transferring surface is being slid into contact with the force transferring surface (e.g., edges of cut-out portion 445 of FIG. 4) of the handle component (e.g., handle component 425), and further to protect the force transferring surfaces 505 from being dented or nicked since transferring of force (resulting from a user rotating the jack handle) may result in the force transferring surfaces 505 and the force transferring surface (e.g., edges of cut-out portion 445 of FIG. 4) of the handle component to grind against one another. In one embodiment, the force transferring surfaces 505 might not be smooth, as smooth surfaces might not transfer force as efficiently. That is, having a higher coefficient of friction may improve the ability of the force transferring surface 505 to engage the force transferring surface, e.g., edges of the cut-out portion 445 of FIG. 4, without slipping. In addition, certain materials may be beneficial for having a higher coefficient of friction, such as cast-iron copper.

Figure 5C:
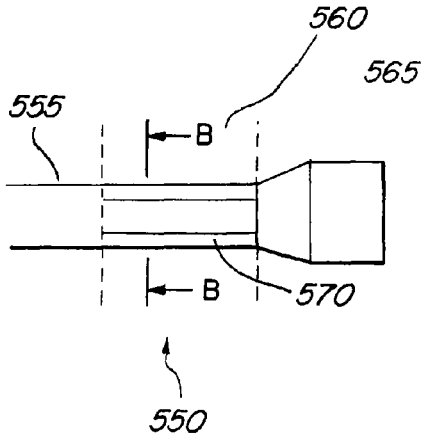
FIG. 5C illustrates a close up view of a male force transferring surface and a stopper of one piece of the jack handle according to one or more embodiments described herein.
Figure 5D:
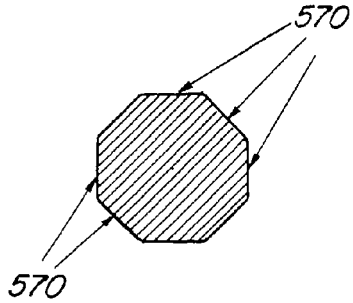
FIG. 5D illustrates a cross-sectional view of the male force transferring surface of FIG. 5C according to one or more embodiments described herein.

FIG. 5C illustrates one embodiment of the interlock piece 550 having a differently shaped exterior configuration as compared to the interlock piece 500 of FIG. 5A. As shown in FIG. 5D, an octagon-shaped interlock portion 570 may be implemented. By increasing the number of sides, and hence, increasing the number and varying the geography of the surfaces that may serve as a force transferring surface, may improve the efficiency of the transfer of force between the handle component (e.g., handle component 425) and the jack mating component (e.g., jack mating component 400). FIG. 5D, a cross section view along axis B-B depicted in FIG. 5C, illustrates the different surface configurations of the force transferring surfaces 570.

While certain embodiments of the interlock piece (e.g., the interlock piece 520 and 550) have been discussed, different embodiments are further within the scope of this invention. For example, in addition to one embodiment having an oblong, rounded shaped body and a second embodiment having an octagon-shaped body, other embodiments of the interlock piece may include a hexagon-shaped, a quadrilateral (e.g., rectangle, square, trapezoid, parallelogram, etc.), non-uniform shapes and the like. However, the embodiments of the interlock pieces described herein may be considered male portions as they are configured to be inserted into a corresponding female portion (e.g., cut-out portion 445) having force transferring surfaces of the corresponding component of the jack handle.

Figure 6A:
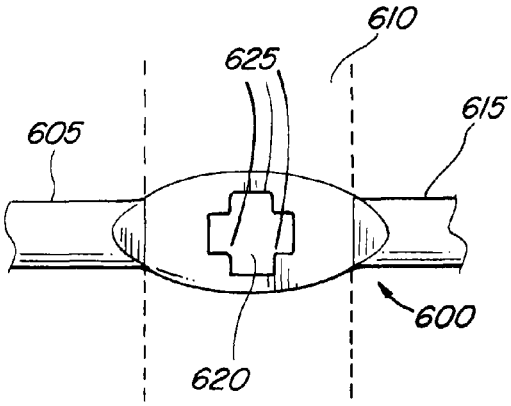
FIG. 6A illustrates a close up view of the female force transferring surface of one piece of the jack handle according to one or more embodiments described herein.

FIG. 6A illustrates one embodiment of a "female" interlock piece 610 configured to receive a "male" interlock piece (e.g., interlock piece 520 or 550). As shown enlarged for clarity, the end portion 600 of the handle component (e.g., handle component 425 of FIG. 4) may include a body portion 605, an interlock piece 610 with a cut-out portion 620 being defined by force transferring surfaces 625, and a tail portion 615. The interlock piece 610 may be "flattened" or pressed having a sheet-like appearance while the end portion 615 and the body portion 605 may be cylindrical in shape. In one embodiment, the handle component (e.g., handle component 425 of FIG. 4) may be manufactured as one piece and the interlock piece 610 may be stamped or otherwise pressed flat and then the cut-out portion 620 may be machine-stamped or laser-cut.

The edges of the cut-out portion 620 may be force transferring surfaces 625 configured to receive and contact force transferring surfaces of the male component (e.g., force transferring surfaces 505 of the interlock piece 520). The interlock piece 520 may fit tightly into the cut-out portion 620. That is, each force transferring surfaces 505 may be in simultaneous physical contact with at least one force transferring surface 625. The points of contact allow force (e.g., torque inputted by the operator of the jack handle during operation of the jack handle) to be transferred to the jack itself, thereby raising or lowering the jack. However, because the shape of the interlock piece 520 and the cut-out portion 620 might not be identical, a gap may remain when the force transferring surfaces (e.g., force transferring surfaces 505 and force transferring surfaces 625) are in physical contact. In one embodiment, the force transferring surfaces 625 may be coated with a layer of erosion-resistant paint or sealant (e.g., acrylic rubber or silicon rubber) for protecting the force transferring surfaces from being worn down from repeated friction created when the force transferring surface 625 is in contact with the force transferring surface (e.g., force transferring surfaces 505 of FIG. 5B) of the jack mating component, and further to protect the force transferring surface 625 from being dented or nicked since transferring of force (resulting from a user rotating the jack handle) may result in the force transferring surface 505 and the force transferring surface (e.g., edges of cut-out portion 625 of FIG. 6A) of the handle component to grind against one another. In one embodiment, the edges acting as the force transferring surfaces 625 might not be smooth, as smooth surfaces might not transfer force as efficiently. That is, having a higher coefficient of friction may improve the ability of the force transferring surface 625 to engage, for example, the force transferring surface 505 of FIG. 5B without slipping. In addition, certain materials may be beneficial for having a higher coefficient of friction, such as cast-iron copper.

In addition, while the cut-out portion 620 is shown to be a cross-shaped opening, any shaped opening able to receive the male interlock piece 520 and contacting the force transferring surfaces (e.g., force transferring surfaces 505 of FIG. 5B) may be possible. For example, the cut-out portion 620 may be a square-shaped opening, a hexagon-shaped opening, and the like.

Figure 6B:
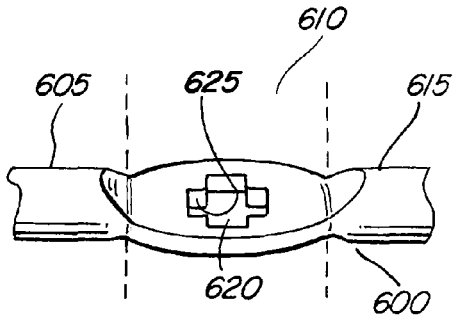
FIG. 6B illustrates a side view of the female force transferring surface of FIG. 6A according to one or more embodiments described herein.

FIG. 6B is a side view of the end portion 600 illustrated in FIG. 6A. As shown, the interlock piece 610 may be substantially thinner when compared to the tail portion 615 and the body portion 605. In one embodiment, interlock piece 610 may define a plane of insertion for the jack handle component (e.g., jack handle 400). That is, the jack handle (e.g., jack handle 400) may cross the plane of insertion in one direction, through the opening of the cut-out portion 620, when being assembled, and may cross the plane of insertion in a second direction, through the opening of the cut-out portion 620 in a reverse direction when being disassembled and separated from the handle component. In one embodiment, the plane of insertion may be lined up with the plane defining the connection (e.g., border) between the interlock piece 520 and the stopper 510 when the jack handle is assembled and in an interlocked position.

In some embodiments, the crank handle (e.g., handle 430 of FIG. 4) and the stopper (e.g., stopper 510) maybe integrated with other tools that may be beneficial in a tire-changing procedure.

Figure 7A:
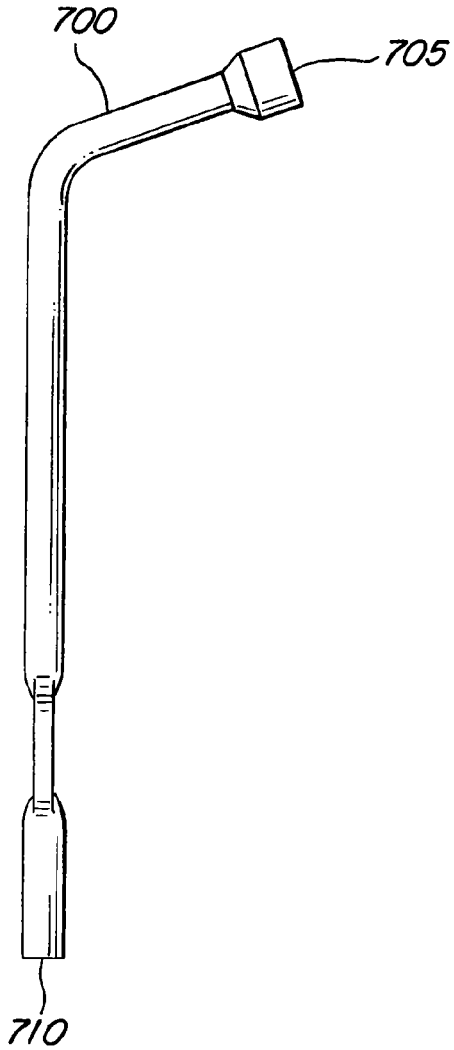
FIG. 7A illustrates a perspective view of a crank handle according to one or more embodiments described herein.
Figure 7B:
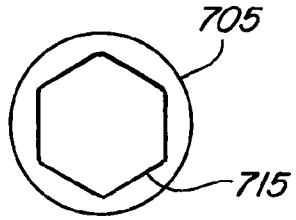
FIG. 7B illustrates a front view of a crank handle head according to one or more embodiments described herein.

For example, FIG. 7A illustrates the jack handle 700 with a crank handle 705 and an end portion 710. FIG. 7B is a front view of the crank handle 705 revealing a lug wrench device 715. The lug wrench device 715 may be beneficially used (when the jack handle is not in operation as a jack handle) to remove lug nuts attaching the wheel to the vehicle axle.

In addition to a component configured to function as a lug wrench, other components may be integrated in other embodiments. For example, in addition and/or alternative to a lug wrench, a different component such as a screw driver head, a hammer head, and the like may be integrated into the end portion 710 and/or the crank handle 705. Or, in one embodiment, a wheel cap removal device may be integrated into the end portion 710.

Figure 8:
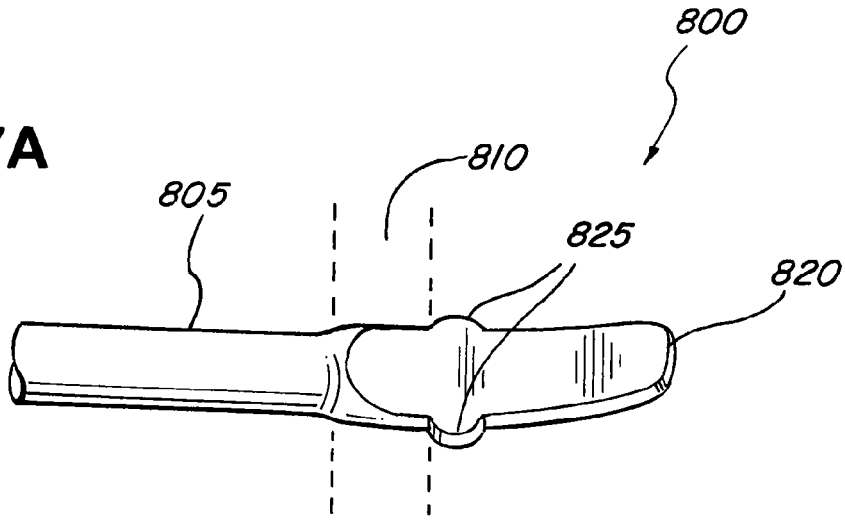
FIG. 8 illustrates a spoon-shaped stopper according to one or more embodiments described herein.

FIG. 8 illustrates one embodiment of a jack mating component 800 having a body 805. Here, the stopper 825 does not incorporate a beaker-shaped portion, but instead utilizes a pair of wings or nodules protruding from the stopper 825 to perform the function of preventing the cut-out portion (e.g., cut-out portion 445) from sliding beyond the interlock portion 810 and past the stopper 825. Separate from or integrated with the stopper 825 may be a curved spoon component 820. The curved spoon component 820, may allow for additional functionality related to, for example, the changing of a tire (when the jack handle is not in operation as a jack handle). The curved spoon 820 may be used to remove or pry open the wheel caps.

In one embodiment, the location and formation of the male and female interlocking portions (e.g., the interlock portion 415 and the cut-out portion 445 of FIG. 4) may be swapped between the jack handle (e.g., jack handle 425) and the jack mating component (jack mating component 400).

Skilled artisans may implement the described functionality in varying ways for each particular application, but such implementation decisions should not be interpreted as causing a departure from the scope of the disclosed apparatus and/or methods.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. An apparatus comprising:

a handle component including:

a handle portion, and a first interlock portion adjacent to the handle portion, the first interlock portion having an opening and a first force transferring surface;

a jack mating component having a first end and a second end and a length therebetween, and including:

a jack mating portion defining the first end of the jack mating component, a body portion having a first end and a second end and a length therebetween, the first end of the body portion being connected to an end of the jack mating portion, the body portion having a thickness along the entirety of the length of the body portion that is sized to allow the entirety of the length of the body portion to be pulled through the opening of the first interlock portion from the first end of the body portion to the second end of the body portion, a second interlock portion having a first end and a second end and a length therebetween, the first end of the second interlock portion being connected to the second end of the body portion, the second interlock portion having a second force transferring surface that is configured to contact the first force transferring surface of the first interlock portion, and a stopper portion having a first end and a second end and a length therebetween, the first end of the stopper portion being connected to the second end of the second interlock portion, the second end of the stopper portion defining the second end of the jack mating component, the length of the stopper portion being less than the length of the jack mating component that extends from the first end of the stopper portion to the first end of the jack mating component, and the stopper portion being sized larger than the opening of the first interlock portion to prevent the first force transferring surface and the second force transferring surface from becoming disengaged when the jack mating portion and then the entirety of the length of the body portion are pulled through the opening of the first interlock portion in a direction away from the first interlock portion.

2. The apparatus of claim 1, wherein the handle portion includes an integrated tool.

3. The apparatus of claim 1, wherein a thickness of the first interlock portion is less than a thickness of the handle portion.

4. The apparatus of claim 1, wherein the opening is a cut-out portion of the first interlock portion and the first force transferring surface includes at least one edge defining the cut-out portion.

5. The apparatus of claim 1, wherein the handle portion is curved, and configured to be grasped and manipulated by a user.

6. The apparatus of claim 5, wherein the second force transferring surface is configured to fit within the opening of the first interlock portion, further wherein the second force transferring surface is an exterior surface of the jack mating component, and configured to receive a force inputted to the handle portion by a user when in contact with the first force transferring surface.

7. The apparatus of claim 5, wherein the stopper portion is configured to prevent the first force transferring surface and the second force transferring surface from becoming disengaged when the jack mating portion and then the entirety of the body portion are pulled through the opening of the first interlock portion in a direction away from the first interlock portion by being too large to fit through the opening of the first interlock portion.

8. The apparatus of claim 7, wherein the jack mating portion is configured to fit through the opening of the first interlock portion and allow the first interlock portion to traverse the jack mating component from the jack mating portion to the stopper portion.

9. The apparatus of claim 8, wherein the first interlock portion detachably receives the jack mating component.

10. The apparatus of claim 9, wherein the jack mating component and the handle component are configured to be in a locked position when the first force transferring surface is in contact with the second force transferring surface and the first interlock portion is pressed against the stopper portion.

11. The apparatus of claim 1, wherein the stopper portion is sized larger than the opening of the first interlock portion to prevent the first force transferring surface and the second force transferring surface from becoming disengaged when the jack mating portion is pulled through the opening of the first interlock portion in a direction away from the first interlock portion, followed by the first end of the body portion being pulled through the opening of the first interlock portion in a direction away from the first interlock portion, and followed by the second end of the body portion being pulled through the opening of the first interlock portion in a direction away from the first interlock portion.

12. The apparatus of claim 1, wherein the second interlock portion has a thickness that is greater than the thickness along the entirety of the length of the body portion.

13. The apparatus of claim 12, wherein the stopper portion has a thickness that is greater than the thickness of the second interlock portion.

14. The apparatus of claim 1, wherein the size of the stopper portion incrementally increases as the stopper portion extends in a direction away from the second interlock portion.

15. The apparatus of claim 1, wherein the opening of the first interlock portion is cross-shaped.

16. The apparatus of claim 1, wherein the stopper portion includes protruding nodules sized to prevent the first force transferring surface and the second force transferring surface from becoming disengaged when the jack mating portion and then the entirety of the length of the body portion are pulled through the opening of the first interlock portion in a direction away from the first interlock portion.

17. The apparatus of claim 1, wherein the second force transferring surface defines an outer surface of the second interlock portion, and the second interlock portion is configured to fit within the opening of the first interlock portion such that second force transferring surface contacts the first force transferring surface.

18. An apparatus comprising:

a rotation handle for being grasped by a user and including a curved neck portion and an aperture extending through the rotation handle; and a pivot arm having a hook at a first end of the pivot arm, a stopper at a second end of the pivot arm that is opposite to the first end, and a center body portion positioned between the first end and the second end, the stopper at the second end being sized larger than the aperture such that the stopper is unable to pass through the aperture, the hook and the center body portion being sized to pass through the aperture such that the hook and the center body portion may be drawn through the aperture until the stopper contacts the rotation handle.

19. The apparatus of claim 18, wherein the stopper is tapered to increase in size as the stopper extends in a direction away from the hook.

20. The apparatus of claim 18, wherein the entirety of the pivot arm that is positioned between the hook and the stopper is sized to pass through the aperture.

* * * * *